US008534014B2

(12) United States Patent
Ahren

(10) Patent No.: US 8,534,014 B2
(45) Date of Patent: Sep. 17, 2013

(54) MAGNETIC CROSS TEES

(75) Inventor: Gregory M. Ahren, Avon Lake, OH (US)

(73) Assignee: USG Interiors, LLC, Chicago, IL (US)

( * ) Notice: Subject to any disclaimer, the term of this patent is extended or adjusted under 35 U.S.C. 154(b) by 274 days.

(21) Appl. No.: 12/980,478

(22) Filed: Dec. 29, 2010

(65) Prior Publication Data

US 2012/0167513 A1 Jul. 5, 2012

(51) Int. Cl.
*E04C 2/52* (2006.01)

(52) U.S. Cl.
USPC ..... 52/220.6; 52/506.07; 52/506.06

(58) Field of Classification Search
USPC ..... 52/506.07, 220.6, DIG. 4, 506.06–506.1
See application file for complete search history.

(56) References Cited

U.S. PATENT DOCUMENTS

| | | | | |
|---|---|---|---|---|
| 3,628,299 | A | 12/1971 | Nakazawa | |
| 4,272,942 | A | 6/1981 | Jackson | |
| 4,486,995 | A | 12/1984 | Allen et al. | |
| 4,535,580 | A * | 8/1985 | Shirey | 52/506.06 |
| 4,635,410 | A | 1/1987 | Chumbley | |
| 4,747,246 | A | 5/1988 | Sanborn | |
| 4,835,923 | A | 6/1989 | Ybarra | |
| 4,934,119 | A | 6/1990 | Ybarra | |
| 5,205,091 | A | 4/1993 | Brown | |
| 5,414,969 | A | 5/1995 | Krejci et al. | |
| 5,836,127 | A | 11/1998 | Clark et al. | |
| 6,125,608 | A | 10/2000 | Charlson | |
| 6,199,337 | B1 | 3/2001 | Colson et al. | |
| 6,314,687 | B1 | 11/2001 | Schondelmayer et al. | |
| 6,415,566 | B2 | 7/2002 | Auer | |
| 6,427,409 | B2 | 8/2002 | Colson et al. | |
| 7,690,158 | B2 | 4/2010 | Kelly | |
| 7,874,116 | B2 * | 1/2011 | LaLonde | 52/506.08 |
| 2003/0122049 | A1 | 7/2003 | Chysna | |
| 2005/0139334 | A1 | 6/2005 | Bernardi | |
| 2008/0229680 | A1 | 9/2008 | Jahn et al. | |
| 2008/0276553 | A1 | 11/2008 | Ingjaldsdottir et al. | |
| 2009/0049796 | A1 | 2/2009 | Grau | |
| 2009/0133342 | A1 * | 5/2009 | Copeland | 52/202 |
| 2010/0130055 | A1 | 5/2010 | Liang et al. | |

FOREIGN PATENT DOCUMENTS

DE 10108135 C1 2/2002

OTHER PUBLICATIONS

International Search Report and Written Opinion dated Mar. 9, 2012 of corresponding International Patent Application No. PCT/US2011/064313, filed Dec. 12, 2011.

* cited by examiner

*Primary Examiner* — William Gilbert
*Assistant Examiner* — Patrick Maestri
(74) *Attorney, Agent, or Firm* — Pearne & Gordon LLP

(57) ABSTRACT

An elongated metal grid runner for a suspended ceiling, the grid runner having a cross-section with an upper hollow reinforcing bulb, a vertical web extending below the bulb, and lower flange elements extending laterally from opposite sides of the web, the length of the grid runner being less than about 9', a permanent magnet disposed on each end of the grid runner at its flange elements, the magnet being adapted to overlie and be attracted to a horizontal leg of a steel wall angle to thereby releasably retain the grid runner in position on the wall angle.

7 Claims, 2 Drawing Sheets

MAGNETIC CROSS TEES

BACKGROUND OF THE INVENTION

The invention relates to building construction and, in particular, to suspended ceilings.

PRIOR ART

Building areas such as corridors or hallways and small rooms typically have short spans between opposing walls. Frequently, the space above such areas is utilized for air ducts and other utilities. It can be desirable or mandatory that a suspended ceiling be provided with removable panels to allow ready access to the space or plenum above a ceiling. The existence of primary air ductwork and other objects in the overhead space often makes hanging conventional suspension wires difficult or prohibitive. Any solution for constructing a suspended ceiling should avoid the need for extensive and/or specialized labor and, ideally, will actually reduce the labor and skill requirements.

SUMMARY OF THE INVENTION

The invention resides in a short span suspended ceiling system with a unique grid runner and wall angle attachment. The attachment is made by permanent magnets carried on the ends of the grid runners that extend perpendicularly to the wall angles. The magnets are arranged to be strongly attached to the horizontal leg of a steel wall angle. The wall angles are of sufficient strength to support the grid runners and the ceiling tiles carried on the grid runners. The invention can be embodied with the type of grid runner that has a box section with an open slot on its bottom face. In this case, a magnet is inserted in the box section at each end of the grid runner. The grid runners are cut to a length such that their ends and the associated magnets overlie the horizontal legs of oppositely facing wall angles.

The invention is useful with the more common style of grid runner or tee with flat flanges at their lower sides. In such a case, the ends of the tees can be modified by displacing material from a web above the flange for reception of a magnet.

With the invention there is no need to index the spacing of a runner along the length of the wall angles. The position of the runners, for example, can be determined by the width of the ceiling tiles or panels as they are being installed or by lengths of short cross runners if the latter are used. The grid runners of the invention can be used in trapped modules where the grid runner ends are supported on elements that, like the wall angles, cannot be deflected or rotated laterally to receive or release a connector designed to extend through such an element, for example.

DESCRIPTION OF THE PREFERRED EMBODIMENTS

Figure 1:
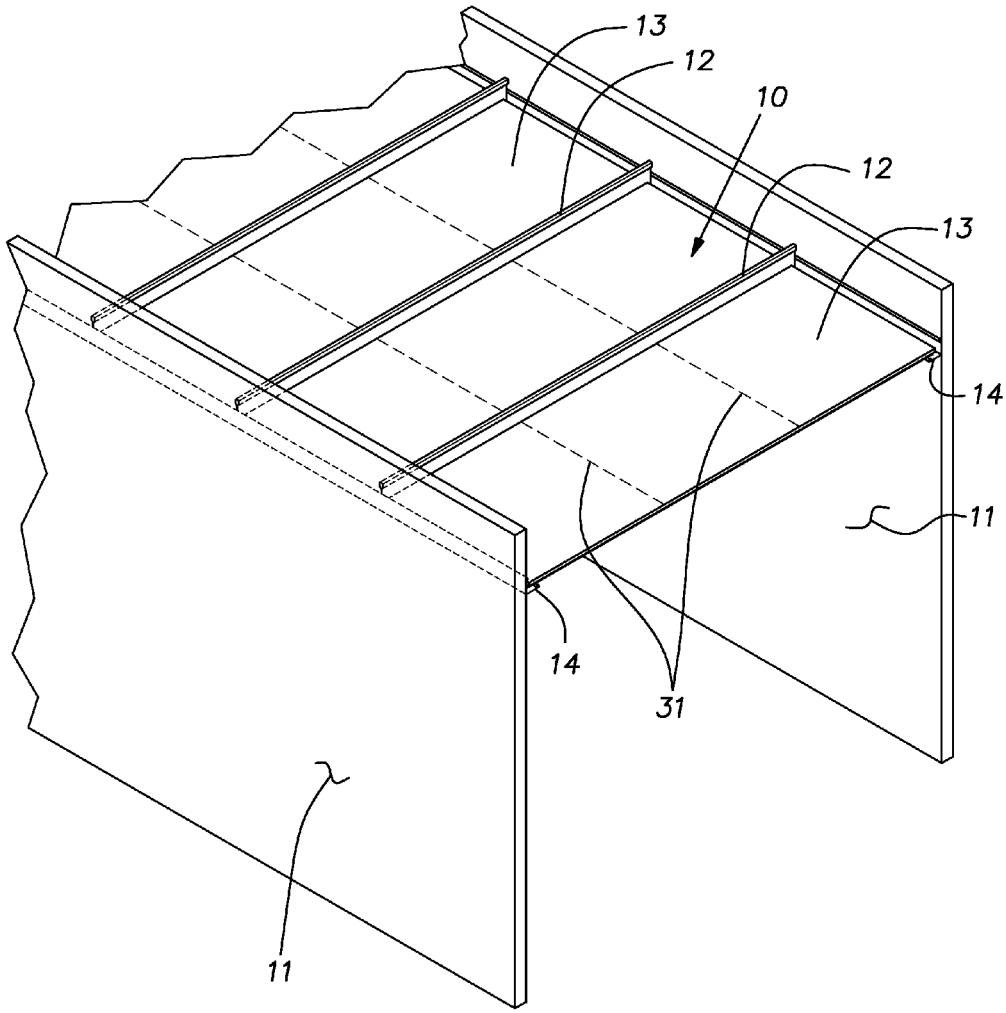
FIG. 1 is a fragmentary isometric view of a short span suspended ceiling system constructed in accordance with the invention.

A short span suspended ceiling is represented at 10. The ceiling 10 and walls 11 can represent, for example, a corridor or hallway that typically is of a length substantially greater than its width. However, the invention can be used for the ceiling of a small room. The ceiling 10 comprises a plurality of spaced parallel grid runners 12, extending transversely to the length of the corridor, and rectangular ceiling panels or tiles 13 carried by the grid runners 12.

On the walls 11, at ceiling height is a pair of opposed, elongated wall angles 14. The wall angles 14 are made of sheet steel which may be hot dipped galvanized and painted. Each wall angle 14 has a horizontal leg 16 and a vertical leg 17.

Figure 2:
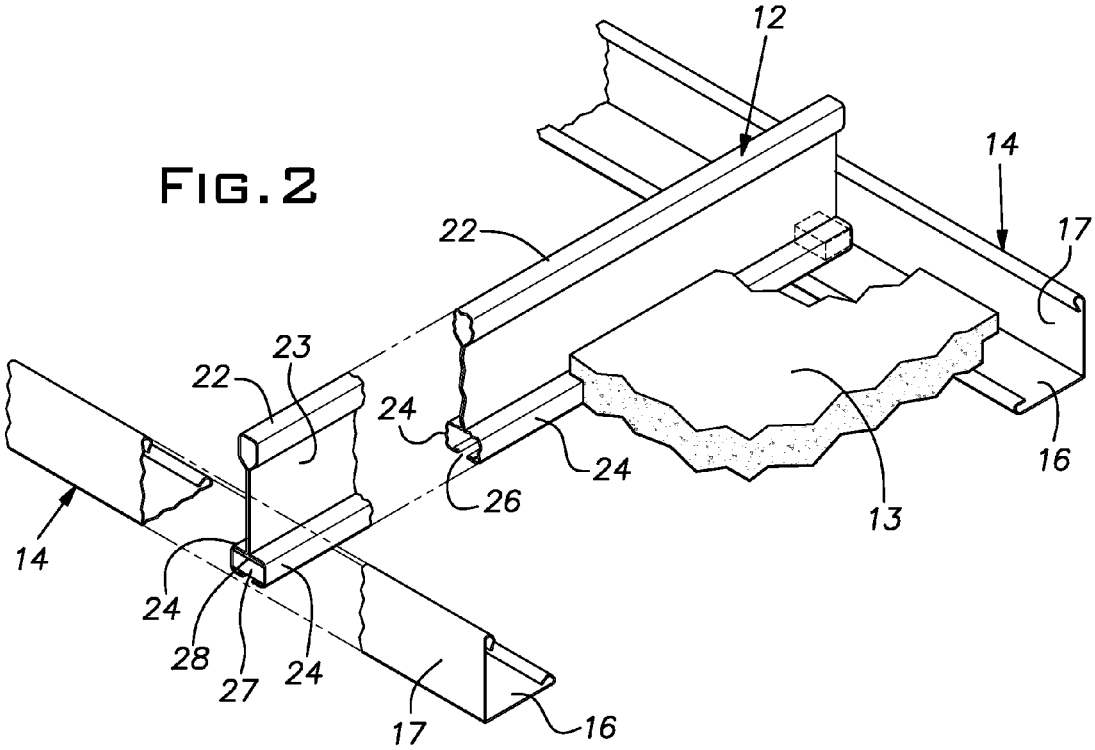
FIG. 2 is a fragmentary isometric view of a grid runner constructed in accordance with the invention shown in relation to supporting wall angles.

The illustrated style of grid runner in FIGS. 1 and 2 is of a known style, disclosed for example in U.S. Pat. No. 4,535,580. This style of grid runner has a hollow box-like structure 21 at its lower side. The profile of the grid runner 12 includes an upper hollow reinforcing bulb 22, a vertical web 23, and two inwardly facing C-shaped flanges 24 that mutually form the box section or structure 21. The flanges 24 are at the lowermost part of the runner 12 and are spaced from one another to leave a gap or slot 26. Typically, the grid runner 12 is roll-formed of sheet steel that can be hot dipped galvanized and painted.

The invention is particularly useful in arrangements where the grid spans a distance of between about 5' to about 9'. At the longer spans within this range, the grid runner can be made of relatively heavy gauge stock and/or can be reinforced by adding layers of sheet steel to the reinforcing bulb 22 and/or can be increased in height to make it stronger. The length of a grid runner 12 is cut to provide moderate clearance with the inside surfaces of the vertical legs 17 of the opposed wall angles 14.

A permanent magnet 27 is assembled at each end of a grid runner 12 into the flange formed box 21. The magnet 27 will tend to hold itself in position in the flange box 21 at which it is placed. An adhesive, indicated at 28, can be used to secure a magnet in position, if desired.

The ceiling tiles 13 can be standard commercially available units typically with nominal rectangular face dimensions of 2'×2', 2'×4', or 2½'×5', or metric equivalents thereof. The ceiling 10 can be constructed by initially installing the wall angles 14 on opposite walls 11 at the desired height. Wall angles, not shown, can be similarly installed at the end or ends of the corridor. Alternatively, a grid runner or runners 12 can be used for starting and ending at the beginning or end of a hallway. Starting at one end of a corridor or hallway, the walls 11 or wall angles 14 can be marked to indicate the desired centers for the grid runners 12. Normally, the runners will be arranged perpendicularly to the walls. Typically, the grid runners 12 will be positioned on 2' centers. The magnets 27, being disposed directly over the horizontal legs 16 of the wall angles 14, will releasably hold the grid runners 12 in the positions at which they are manually set. The tiles 13 can be laid on the grid runners 12 in a conventional manner by manipulating them through the plane of the grid runners 12. If desired, the steps of laying out the centers of the grid runners along the respective walls angles 14 can be omitted and the grid runners 12 can be roughly positioned on the wall angles. Thereafter, successive grid runners 12 can be more precisely positioned using a row of installed tiles 13 as a gauge. From the foregoing, it will be understood that the position of a grid runner 12 along a wall angle 14 is not dictated by locating features on the wall angle. The magnets 27 will hold their respective grid runner ends firmly, but releasably, in place on the wall angles 14. The grid runners are installed in a so-called "trapped module" where there is no horizontal freedom available for the wall angles 14.

The broken lines 31 in FIG. 1 represent abutting edges of panels 13 or locations of cross runners aligned with the walls 11. As is conventional, the panels or tiles 13 can be cut to fit the width of the corridor. If desired, the grid runners 12 can be provided with regularly spaced slots along their lengths. Such slots, in a conventional manner, can receive connectors on the ends of the cross runners as is known in the art and shown, for example, in aforementioned U.S. Pat. No. 4,535,580.

It will be understood that the ceiling components comprising the wall angles 14, grid runners 12, and tiles 13, can be installed in locations where there is little or essentially no overhead clearance available in the space above the ceiling 10. Moreover, a high level of access is afforded to the space above the ceiling 10 since an installed grid runner 12 can be moved out of position by simply lifting the tiles 13 it supports and shifting it along the wall angles 14. A grid runner 12 can be completely removed from the ceiling 10 with intuitive motion, not requiring special technique and not requiring any movement of the supporting wall angles 14. Temporary removal of one or more grid runners 12, as well as associated ceiling tiles 13 afforded by the invention, gives full unobstructed access to the plenum above the ceiling. The risk of damaging these displaced ceiling parts is reduced where work is being conducted through the plane of the ceiling.

Figure 3:
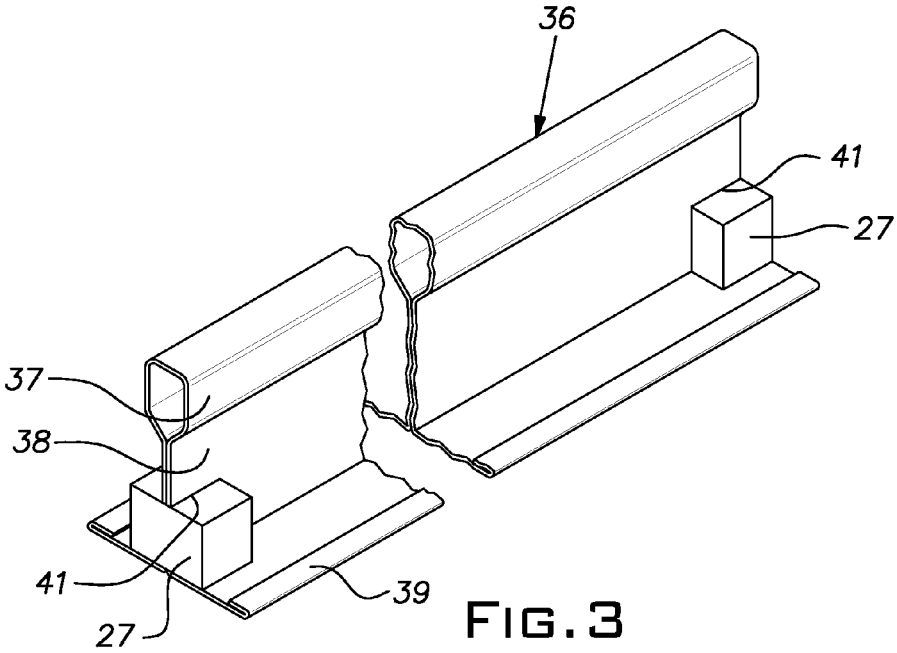
FIG. 3 is a fragmentary isometric view, similar to FIG. 2, showing an alternative grid runner profile.

FIG. 3 illustrates the invention applied to a common form of grid runner that has the general shape of an inverted tee. The grid runner or tee 36, as is typical, is roll formed of sheet steel and includes a hollow upper reinforcing bulb 37, a vertical web 38, and a lower flat flange 39, extending on opposite sides of the web. The web 38 is notched at each end of the grid runner 36 to receive a respective permanent magnet 27. To supplement the attractive force on the grid runner 36, the magnet can be adhesively secured to the runner and/or the notch, designated 41, can be configured to mechanically hold the magnet in position. The grid runner or tee 36 can be used in the manner described above in connection with the grid runner 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An elongated metal grid runner for a suspended ceiling, the grid runner having a cross-section with an upper hollow reinforcing bulb, a vertical web extending below the bulb, and lower flange elements extending laterally from opposite sides of the web, the length of the grid runner being less than about 9', a permanent magnet disposed on each end of the grid runner at its flange elements, the magnet being adapted to overlie and be attracted to a horizontal leg of a steel wall angle to thereby releasably retain the grid runner in position on the wall angle, said flange elements forming a hollow box and the magnets being disposed in the box.

2. A grid runner as set forth in claim 1, being roll-formed sheet metal.

3. A grid runner as set forth in claim 1, wherein the magnets are adhesively attached to the grid runner.

4. A suspended ceiling grid comprising a pair of oppositely facing wall angles secured to respective walls, the wall angles being formed of sheet steel and having vertical and horizontal legs, a plurality of runners spanning the area between the wall angles and being supported on the horizontal legs of the wall angles, the runners being in spaced parallel relation to each other and perpendicular to the wall angles, the runners having permanent magnets on their ends overlying the horizontal leg of the respective wall angle serving to releasably hold the runners in place on the wall angles, the grid runners being of the type having a hollow box-like formation at their lower sides, the magnets being disposed in said box-like formation.

5. A suspended ceiling grid comprising a pair of oppositely facing wall angles secured to respective walls, the wall angles being formed of sheet steel and having vertical and horizontal legs, a plurality of runners spanning the area between the wall angles and being supported on the horizontal legs of the wall angles, the runners being in spaced parallel relation to each other and perpendicular to the wall angles, the runners having permanent magnets on their ends overlying the horizontal leg of the respective wall angle serving to releasably hold the runners in place on the wall angles, the grid runners having the general shape of an inverted tee with an upper hollow reinforcing bulb, a vertical web below the bulb and flange elements extending laterally from opposite sides of a lower edge of the web, the web being displaced at the ends of the runners to accommodate the magnets.

6. A suspended ceiling grid as set forth in claim 4, wherein portions of the box-like formations are disposed between the magnets and the horizontal legs of the wall angles.

7. A suspended ceiling grid as set forth in claim 5, wherein the flange elements are disposed between the magnets and the horizontal legs of the wall angles.

* * * * *